United States Patent [19]

Inoue

[11] 4,430,167

[45] Feb. 7, 1984

[54] METHOD OF AND APPARATUS FOR ELECTRODEPOSITING A METAL ON A SUBSTRATE

[75] Inventor: Kiyoshi Inoue, Tokyo, Japan

[73] Assignee: Inoue-Japax Research Incorporated, Yokohama, Japan

[21] Appl. No.: 405,604

[22] Filed: Aug. 5, 1982

[30] Foreign Application Priority Data

| | | | |
|---|---|---|---|
| Aug. 7, 1981 | [JP] | Japan | 56-122939 |
| Sep. 10, 1981 | [JP] | Japan | 56-141661 |
| Sep. 11, 1981 | [JP] | Japan | 56-142402 |

[51] Int. Cl.[3] ..... C25D 5/04; C25D 7/04; C25D 17/00

[52] U.S. Cl. ..... 204/25; 204/26; 204/225

[58] Field of Search ..... 204/23, 25, 26, 14 R, 204/225

[56] References Cited

U.S. PATENT DOCUMENTS

| | | | |
|---|---|---|---|
| 1,809,826 | 6/1931 | Bohlman | 204/26 |
| 4,269,672 | 5/1981 | Inoue | 204/23 |
| 4,364,802 | 12/1982 | Inoue | 204/25 |

FOREIGN PATENT DOCUMENTS

| | | | |
|---|---|---|---|
| 55-44589 | 3/1980 | Japan | 204/26 |

*Primary Examiner*—T. M. Tufariello

*Attorney, Agent, or Firm*—Karl F. Ross; Herbert Dubno

[57] ABSTRACT

A method of and apparatus for electrodepositing a metal upon a substrate having one or more recesses of substantial depth to form the metal deposit throughout the surfaces and in the recesses as well. An electrode assembly comprises an elongate anode and a tubular insulator traversed by the elongate anode so that the insulator partially covers the lateral surface of the electrode which is movable in its longitudinal direction. The electrode assembly is positioned to dispose a forward end portion thereof in the recess and to position the tubular insulator on the elongate anode so as to allow only a forward end face portion of the anode to be substantially exposed and the face portion to be juxtaposed with a floor portion of the substrate in the recess. An electrodepositing solution is supplied into the recess and an electric current is passed between the anode and the substrate to permit the metal from the solution to be selectively electrodeposited on the floor portion. Subsequently, the tubular insulator is gradually withdrawn while permitting the elongate anode to remain stationary to progressively increase the lateral area of the elongate anode exposed from the insulator, thereby progressively displacing the region of electrodeposition on the wall surface in the recess.

22 Claims, 3 Drawing Figures

METHOD OF AND APPARATUS FOR ELECTRODEPOSITING A METAL ON A SUBSTRATE

FIELD OF THE INVENTION

The present invention relates to electrodeposition and, more particularly, to a new and improved method of and apparatus for electrodepositing a metal upon a substrate having one or more recesses or cavities and electrodepositing the metal thoroughly on the surfaces in the recesses as well as on other desired surfaces of the substrate.

BACKGROUND OF THE INVENTION

Electrodeposition may entail an intricate contour. For example, electroforming has been used extensively for forming dies, electrical machining electrodes and other articles which are difficult to shape by mechanical processes or whose manufacture by mechanical or other means is not economically or otherwise justified. In general, a mold for electroforming is intricate in shape or uneven, necessarily presenting one or more recessed areas which are often relatively narrow and of substantial depth. It is desirable that the electroform be of a uniform thickness or of a desired thickness distribution over the entire areas of such an intricate or uneven contour. Furthermore, it is often desirable that metal deposit be thinner in projected areas and thicker in recessed areas; however, such requirements are generally opposed to the intrinsic tendency of electrodeposition. Thus in general, electrodeposits tend to be thicker in projecting areas, e.g. on ridges or convex angular portions, and to be thinner in recessed areas. In a recess, the electrodeposit tends to concentrate at the opening corner portion thereof with very little or practically even no deposit likely to occur on the floor and the corner edge portion thereof.

OBJECTS OF THE INVENTION

An object of the present invention is to provide a novel method whereby the surface in a recess or cavity of a substrate is thoroughly electrodeposited with a metal readily and without failure and the recessed substrate is thoroughly electrodeposited uniformly or to a desired thickness distribution over the entire area thereof.

Another object of the present invention is to provide an electrodepositing apparatus for carrying out the method described.

SUMMARY OF THE INVENTION

In accordance with the present invention there is provided a method of electrodepositing a metal on an uneven substrate having at least one recess of substantial depth to form the metal deposit thoroughly on the surfaces of the recess as well as on the substrate generally, which method comprises the steps of: (a) passing an elongate anode through a tubular insulator to provide an electrode assembly; (b) positioning the electrode assembly relative to the substrate to dispose a forward end portion of the assembly in the recess and positioning said insulator on the elongate anode so as to allow only a forward end face portion of the anode to be substantially exposed from the insulator and the face portion to be juxtaposed with a floor portion of the substrate in the recess; (c) supplying an electrodepositing solution into the recess and passing an electric current between the anode and the substrate while maintaining the positional relationship achieved in step (b) to permit the metal from the solution to be at least preferentially electrodeposited on the floor portion; (d) subsequent to step (c), continuing supply of the solution and passage of the electric current while substantially maintaining the position of the elongate anode established in step (b) and gradually withdrawing the tubular insulator to progressively increase the lateral area of the elongate anode exposed from the insulator, thereby progressively displacing the region of electrodeposition on the wall surface in the recess; and (e) subsequent to step (d), withdrawing the elongate anode from the recess.

The electrodepositing solution is preferably forced to flow into the recess in step (c) at a predetermined flow rate greater than in step (d). Preferably, the elongate anode is tubular and formed with an inner passage open in the forward end face portion and the solution is forced to flow into the recess through the inner passage.

Preferably, the method further comprises the step of: subsequent to step (c) and prior to step (d), (f) relatively displacing the substrate and said electrode assembly along a predetermined path in a plane transverse to the direction of withdrawal in step (e) while continuing supply of the solution and passage of the electric current to assure electrodeposition on a corner edge portion adjoining the floor and wall surfaces of the substrate in the recess. The electrodepositing solution should preferably be supplied into steps (c), (d) and (f) at varying flow rates. In this case, a maximum flow rate is employed in step (f). The electric current is passed between the anode and the substrate in steps (c), (d) and (f) at varying magnitudes. In this case, a maximum current magnitude is employed in step (f). A current magnitude should be employed in step (c) which is greater than in step (d). It is desirable that in step (c) the electrode assembly be halted for a predetermined time period. The anode and the substrate is relatively displaced at a rate of displacement in step (f) lower than in step (d).

In accordance with a further feature of the invention, the method further includes the step of: (g), outside of the one or more recesses, displacing the electrode assembly relative to the substrate to sweep the forward end face portion of the anode in a scanning manner over the remaining surface areas of the substrate while continuing supply of the solution onto those areas and passage of the electric current between the anode and the substrate. In step (g), preferably, the rate of displacement, the magnitude of the electric current and/or the delivery of the solution into those areas can be controlled in accordance with the respective shape characteristics of the areas.

An apparatus for carrying out the method includes: an electrode assembly comprising an elongate anode and a tubular insulator adapted to be passed by the elongate anode so as to partially cover the lateral surface thereof and movable in its longitudinal direction; first drive means for relatively displacing the elongate anode and the substrate; second drive means independent of the first drive means for displacing the tubular insulator relative to the elongate anode; fluid supply means for supplying an electrodepositing solution onto the substrate; power supply means for passing an electric current between the anode and the substrate; and control means adapted to be furnished with preprogrammed instructions to act on the first and second drive means for movement of the electrode assembly, the anode and the insulator in step (b), (c) and (d), and further in steps (f) and (g).

BRIEF DESCRIPTION OF THE DRAWING

These and other features of the present invention as well as advantages thereof will become more readily apparent from a reading of the following description when taken with reference to the accompanying drawing in which.

SPECIFIC DESCRIPTION

Figure 1:
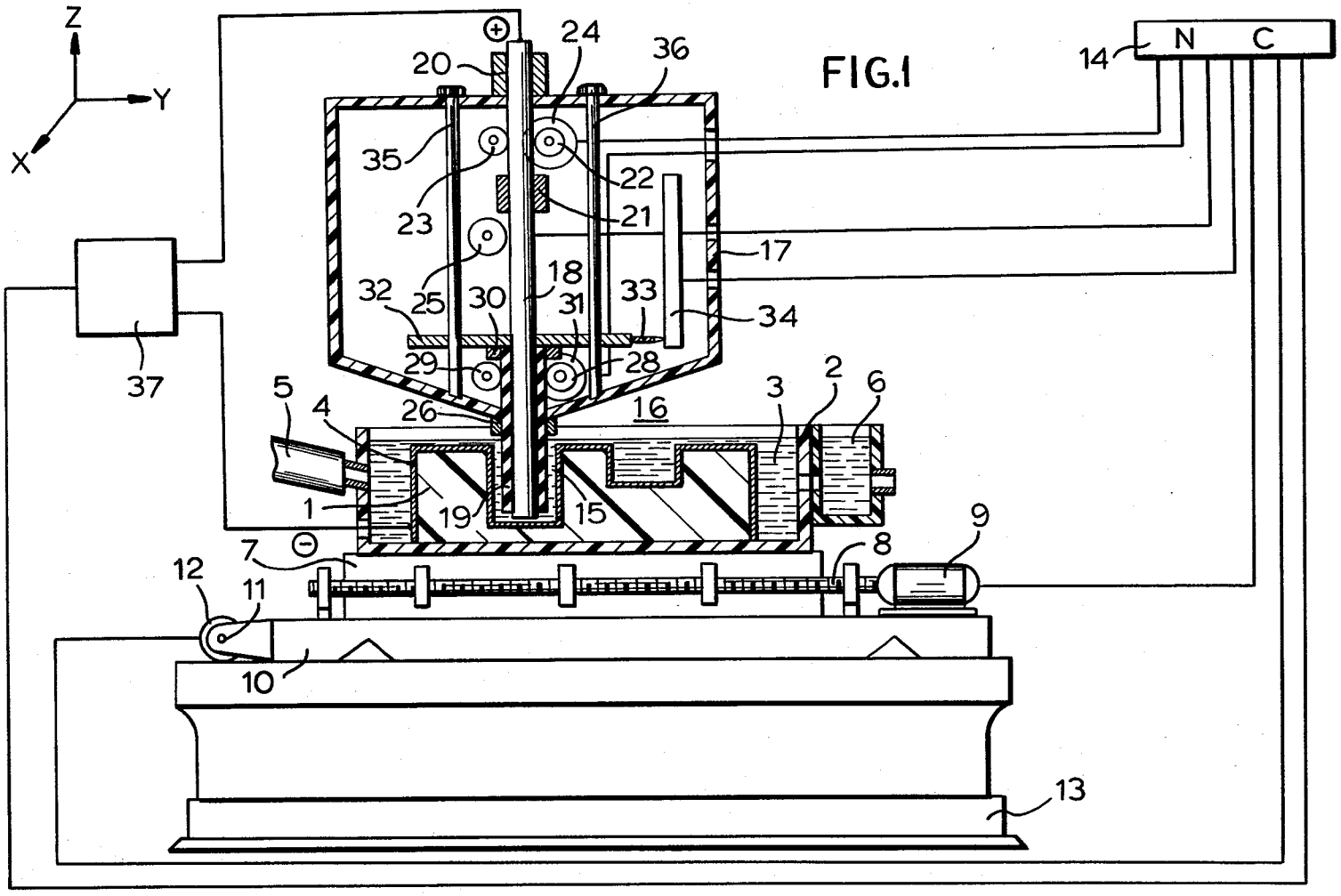
FIG. 1 is a sectional view partly in a block-diagram form illustrating an apparatus according to the present invention.

Referring now to FIG. 1, an electroforming mold 1 composed, say, of a plastic is shown securely accommodated in an electrically nonconductive worktank 2 and immersed in an electrodepositing solution 3 contained therein. The mold has a thin metallic coating 4 previously applied on a surface area thereof, say, by chemical plating, to serve as a conductive electroforming substrate. The solution 3 is supplied through an inlet pipe 5 to the worktank 2 continuously or intermittently, and is allowed to flow out through an outlet conduit 6.

The worktank 2 is securely mounted on a table 7 which is adapted to be driven via a leadscrew 8 by a motor 9, e.g. a stepping motor, in the direction of a Y-axis on a table 10. The latter is adapted to be driven via a leadscrew 11 by a motor 12, e.g. a stepping motor, in the direction of an X-axis which is orthogonal to the Y-axis on a base 13. The motors 9 and 12 are driven by drive signals supplied from a control unit 14, e.g. a numerical controller, to displace the worktank 2 and hence the mold 1 in an X-Y or horizontal plane for positioning the mold 1 in the X-Y coordinate system.

The contour of the electroforming mold 1 includes a deep recess or cavity 15. Shown extending into the recess or cavity 15 is an electrode assembly 16 which is movable vertically or in the direction of a Z-axis perpendicular to the X-Y plane. The electrode assembly 16 is supported by a hollow electrode head 17 so as to be movable relative thereto and comprises an elongate anode 18 slidably received in an insulating sheath or tubular insulator 19 composed, say, of a ceramic. The elongate anode 18 slidably extending through the insulating sheath 19 is passed slidably through guide sleeves 20 and 21 secured to the head 17 and is movable vertically or along the Z-axis by a drive comprising a capstan 22 and a pinch roller 23. The motor 24 of the capstan 22 is driven with a signal from the control unit 14 to establish the position of the lower end portion of the elongate anode 18 in the cavity or recess 15 of the mold 1. The position of the elongate anode 18 is sensed by an encoder 25 whose output is fed back to the control unit 14. The insulating sheath 19 is passed slidably through a guide sleeve 26 secured to the head 17 about a lower central opening 27 thereof and is vertically moved by a drive comprising a capstan 28 and a pinch roller 29. The sheath 19 is slidably supported through a guide sleeve 30 in the head 17. The motor 31 for the capstan 28 is driven with a signal from the control unit 14 to displace the insulating sheath 19 on the elongate anode 18, thereby progressively moving the area of the lateral surface of the latter exposed to the electro-depositing solution 3 and juxtaposed with the side wall of the cavity 15 in the mold 1. The insulating sheath 19 is formed at its upper end with a disk 32 having a needle 33 secured thereto and extending laterally. The position of the needle 33 and hence the position of the insulating sheath 19 is sensed by an encoder 34 whose output is fed back to the control unit 14. The disk 32 is slidably supported by parallel bars 35 and 36 secured to and extending vertically across the head 17. The electrode head 17 is mounted on an arm or column (not shown) of the machine so as to be vertically positionable manually or by a motor (not shown).

The anode 18 and the conductive layer 4 formed on the mold 1 to constitute the cathode are electrically connected to an electrodepositing power supply 37 which provides an electric potential that may be a continuous DC voltage but is preferably in the form of a succession of DC pulses. The output characteristics of the power supply 37 may be controllable in the electroforming process in accordance with a predetermined program stored in the control unit 14.

In the arrangement shown and described, it is seen that the elongate anode 18 has its forward end face always exposed to the electrodepositing solution 3 and juxtaposed with the floor of the cavity 15 and its lateral surface controlledly exposed by displacing the insulating sheath 19.

In electrodepositing the entire surface of the cavity 15, the capstan 22 is driven in response to the control unit 14 to bring the forward (lower) end portion of the electrode assembly 16 and the forward end face of the anode 18 into juxtaposition with the floor surface of the cavity 15. In the state reached, the insulating sheath 19 should be so positioned on the anode 18 that only a forward end portion of the anode 18 is exposed from the insulating sheath 19 and to the electrodepositing solution 3. Thus, the forward end face of the cylindrical insulating sheath 19 should be positioned to be substantially flush with the forward end face of the columnar anode 18 received therein. In this case, slight exposure of the edge portion of the forward end face from the insulating sheath 19 is possible and is often preferred. In the state established, the electrodepositing current from the power supply 37 is passed between the anode 18 and the cathode 4, selectively across the floor surface portion of the cavity 15. The motor 9 and 12 may then be driven to cause the forward end portion of the anode 18 to sweep in a scanning manner over the entire area of the floor portion in the cavity 15 including the corner edge or edges thereof. The scanning rate is then preferably controlled by the control unit 14 in a preprogrammed fashion.

After substantial completion of electrodeposition on the entire surface area of the floor portion of the cavity 15, the capstan 28 is driven in response to the control unit 14 to gradually raise the insulating sheath 19 to progressively increase the lateral surface area of the anode 18 exposed to the electrodepositing solution 3, thereby permitting the region of the selective electrodeposition on the lateral walls of the cavity 15 to progressively shift upwards. The rate of upward displacement of the insulating sheath 19 is preprogrammed in the control unit 14. By the provision of the encoder 34 designed to instantaneously monitor the position of the insulating sheath 19, the drive system is here advantageously closed-looped.

During electrodeposition in the recess 15, the control unit 14 acts on the power supply 37 to control the output thereof so that the electrodepositing current is greater in magnitude while the electrode assembly 16 is stationary to hold the anode 18 juxtaposed with the floor portion of the recess 15 than while the insulating sheath 19 is withdrawn upwards. A predetermined greatest current magnitude should be employed while the anode 18 is working on the corner edge portion of the floor.

Upon completion of electrodeposition on the wall portions in the cavity 15 achieved throughout in this manner, the capstan 22 is driven in response to the control unit 14 to raise the anode 18 through the convering sheath 19 and hence to withdraw the electrode assembly 16 from the cavity 15. Thereafter the motors 9 and 12 are driven in response to the control unit 14 to move the electrode assembly 16 horizontally and to commence electrodeposition on a subsequent preprogrammed area of the surface of the mold 1.

Figure 2:
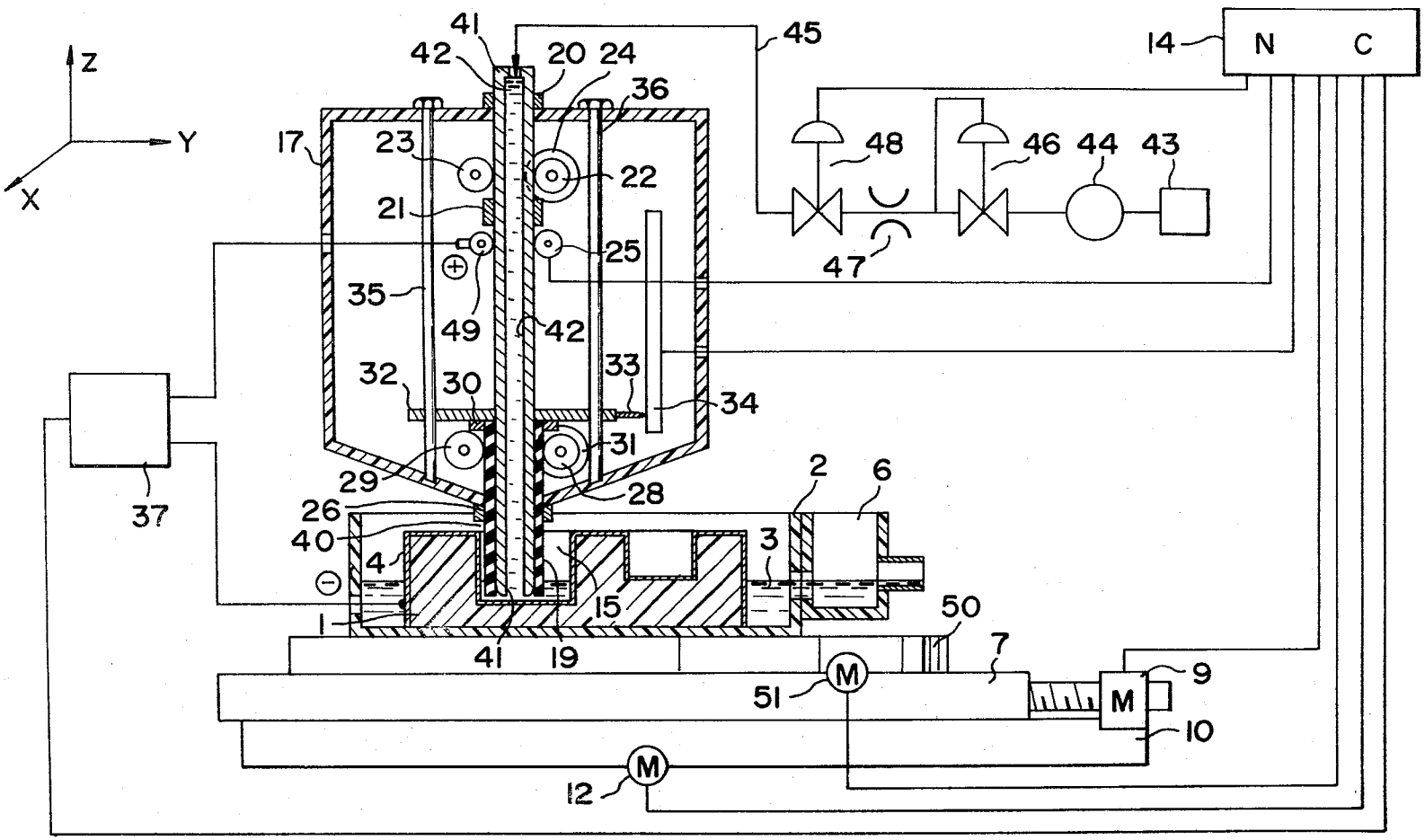
FIG. 2 is a similar view diagrammatically illustrating a modification of the apparatus of FIG. 1.

FIG. 2 shows a modification of the embodiment of FIG. 1 according to the present invention and makes use of the same reference numerals as in FIG. 1 to designate the same or functionally same parts or components of the apparatus. In the embodiment of FIG. 2, the electrode assembly 40 comprises a tubular elongate anode 41 which is slidably received in the insulating sheath 19 as in the embodiment of FIG. 1. The elongate anode 41 is thus formed with an internal passage 42 through which the electrodepositing solution 3 from a reservoir 43 is delivered into the region of electrodeposition under pressure by a pump 44. The fluid conduit 45 connecting the reservoir 43 includes a pressure regulating valve 46 for the pump 44, a throttle valve 47 and a flow-volume conrol valve 48 for the electrodepositing solution 3 to be supplied into the tubular anode 41. The flow-volume control valve 48 is designed to be controlled by the control unit 14.

In addition, the positive terminal of the electrodepositing power supply 37 is shown as connected to the anode 41 via a conducting roller 49 while its negative terminal is electrically connected to the conductive layer 4 preformed on the nonconductive electroforming mold. Means for displacing the worktank 2 includes a turntable 50 driven by a motor 51 on the Y-axis drive table 7 which is arranged with the X-axis drive table 10 in a cross-feed configuration as in the system of FIG. 1.

In the practice of electrodeposition on an intricate mold 1 with the system of FIG. 2, it will be apparent that the worktank 2, the elongate anode 41 and the insulating sheath 19 can be displaced in same manners as with the system of FIG. 1. In addition, the valve 48 is controlled in response to the control unit 14 to control the volume flow rate of the electrodepositing solution 3 supplied thorugh the anode passage 42 into and through the region of electrodeposition in the worktank 2. Thus, the rate of supply of the electrodeposition is increased where the active forward region of the electrode assembly 40 is working an area which by reason of its shape or configuration is not readily electrodepositable, thereby enhancing the electrodepositability on the area. Conversely, the rate of supply of the electrodepositing solution 3 is reduced where the active forward region of the electrode assembly 40 works an area which is rather readily electrodepositable. The result is that an electrodeposited layer is formed with a uniform thickness throughout the intricate surface desired. Furthermore, the consecutive renewal of the solution 3 in the course of the novel spanning operation assures a marked increase and constancy of the concentration of the metal ions in the region of the vary surface areas of the mold, thus largely reducing the total electrodepositing time required.

Accordingly it will be apparent that the present invention enables forming readily, with certainty and in a minimum operating time, on any electrodepositable substrate, even of a highly intricate contour, an excellent electrodeposited layer of metal which has a desired thickness distribution and which is free from either a portion of excess deposit or a portion of insufficient deposit.

Figure 3:
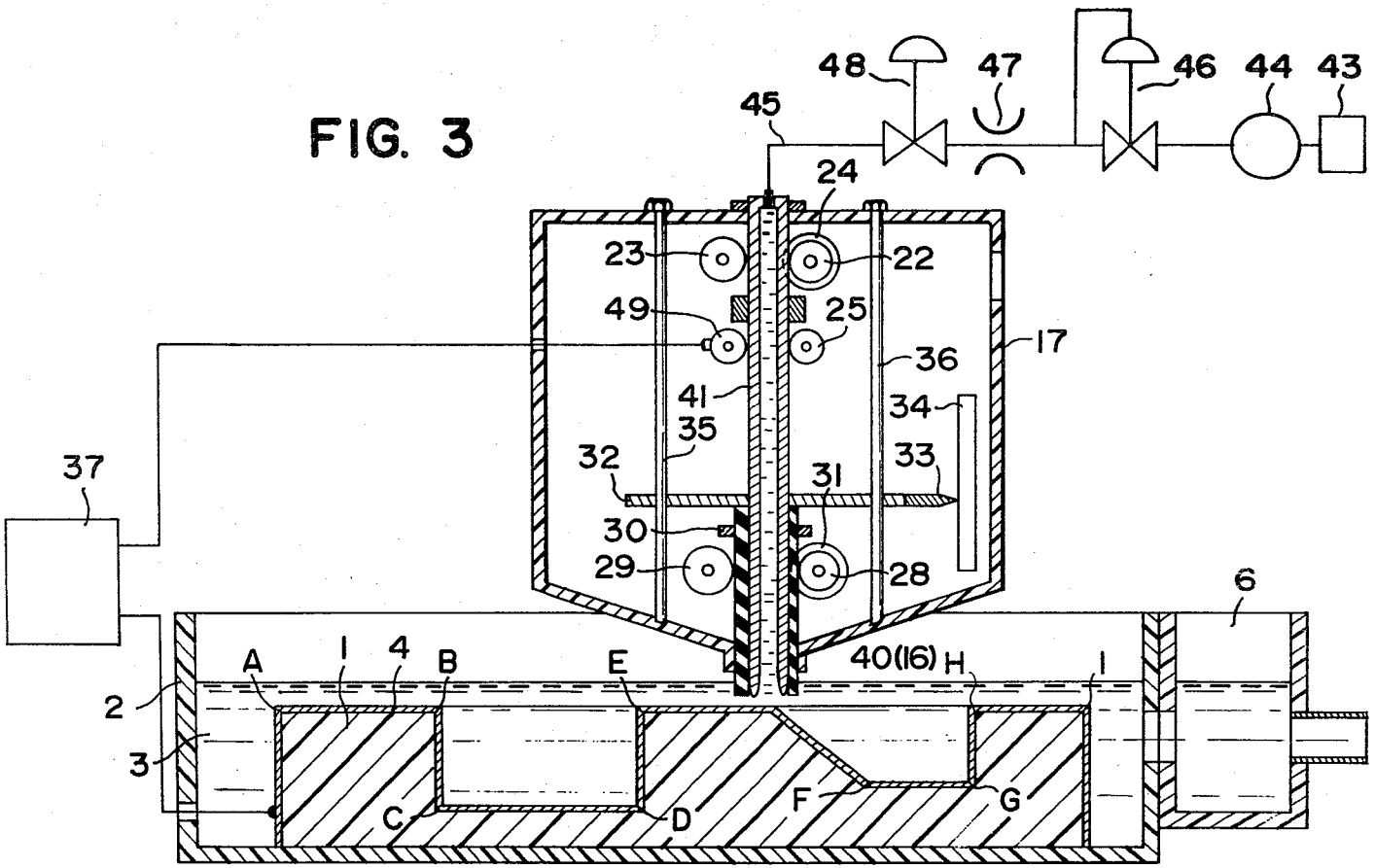
FIG. 3 is a sectional view diagrammatically illustrating an electrodepositing operation according to the method of this invention.

FIG. 3 shows in a sectional view a mold 1, including locations of various geometrical or shape characteristics A, B, C, D, E, F, G, H and I, being scanned by the electrode head 16 of FIG. 2 or FIG. 1 for receiving a uniform layer of electrodeposit upon the conductive substrate 4. It is known that such locations as C, D, F and G positioned at corners of recesses are not readily electrodepositable. In the practice of the present invention, the efficiency of electrodeposition at these locations is enhanced by causing the electrodepositing current to be concentrated selectively at each of these locations. This can be achieved by covering the anode 41 or 18 with the insulating sheath 19 to allow only a forward end portion thereof to be exposed to the electrodepositing solution 3 and to be selectively juxtaposed with each of these locations. Furthermore, the rate of relative displacement between the anode 41 or 18 and the mold 1 should preferably be reduced to a minimum rate of 1 to 10 cm/sec in the region of each of the locations C. D, F and G. It should be noted that it is often desirable to temporarily halt the relative displacement for a predetermined time duration in a region of minimum electrodepositability such as a corner portion of the floor of a deep recess. In addition, the rate of supply of the electrodepositing solution 3 should be increased selectively in the region of each of C, D, F, and G. In the region of F which is greater in depositability than C, D and G, the rate of relative displacement should be relatively high. On the other hand, the rate of relative displacement between the anode 41(18) and the mold 1 should be increased to a maximum rate of 0.1 to 1 m/second while the portions of A to B, E to F and H to I are being scanned. In addition, the rate of supply of the electrodepositing solution 3 should be reduced in these regions. In the recess 15, the flow rate should be greater while the electrode assembly is stationary to hold the anode 18 juxtaposed with the floor portion than while the insulating sheath 19 is being withdrawn upwards. A maximum flow rate should be employed while the anode 18 is working on the corner edge portion of the recess 15.

What is claimed is:

1. A method of electrodepositing a metal on an uneven substrate having at least one recess of substantial depth to form a metal deposit throughout surfaces within the recess the method comprising the steps of:

(a) passing an elongate anode through a tubular insulator to provide an electrode assembly;

(b) positioning said electrode assembly relative to said substrate to dispose a forward end portion of said assembly in said recess and positioning said insulator on said elongate anode so as to allow only a forward end face portion of the anode to be substantially exposed from said insulator and said face portion to be juxtaposed with a floor portion of the substrate in said recess;

(c) supplying an electrodepositing solution to said recess and passing an electric current between said anode and said substrate while maintaining the positional relationship achieved in step (b) to permit the metal from the solution to be at least preferentially electrodeposited on said floor portion;

(d) subsequent to step (c), continuing supply of said solution and passage of said electric current while substantially maintaining the position of said elongate anode established in step (b) and gradually withdrawing said tubular insulator to progressively increase the lateral area of said elongate anode exposed from said insulator, thereby progressively displacing the region of electrodeposition on the wall surface in said recess; and (e) subsequent to step (d), withdrawing said elongate anode from said recess.

2. The method defined in claim 1 wherein said electrodepositing solution is supplied into said recess in step (c) at a predetermined flow rate greater than in step (d).

3. The method defined in claim 1 or claim 2 wherein said elongate anode is tubular and formed with an inner passage open in said forward end face portion and said solution is supplied to said recess through said inner passage.

4. The method defined in claim 3, further comprising the step of: (f), subsequent to step (c) and prior to step (d), relatively displacing said substrate and said electrode assembly along a predetermined path in a plane transverse to the direction of withdrawal in step (e) while continuing supply of said solution and passage of said electric current to assure electrodeposition on a corner edge portion adjoining said floor and wall surfaces of the substrate in said recess.

5. The method defined in claim 1, further comprising the step of: (f), subsequent to step (c) and prior to step (d), relatively displacing said substrate and said electrode assembly along a predetermined path in a plane transverse to the direction of withdrawal in step (e) while continuing supply of said solution and passage of said electric current to assure electrodeposition on a corner edge portion adjoining said floor and wall surfaces of the substrate in said recess.

6. The method defined in claim 5 wherein said electrodepositing solution is supplied into steps (c), (d) and (f) at varying flow rates, further comprising the step of maximizing said rate of flow of said solution into said solution in step (f).

7. The method defined in claim 5 or claim 6 wherein said electric current is passed between said anode and said substrate in steps (c), (d) and (f) at varying magnitudes, further comprising the step of maximizing said electrical current magnitude in step (f).

8. The method defined in claim 7 wherein said electric current is passed between said anode and said substrate in step (c) at a predetermined current magnitude greater than in step (d).

9. The method defined in claim 1 wherein said electric current is passed between said anode and said substrate in step (c) at a predetermined current magnitude greater than in step (d).

10. The method defined in claim 1, further comprising the step of halting said electrode assembly in step (c) for a predetermined time period.

11. The method defined in claim 5 wherein said anode and said substrate are relatively displaced in step (f) at a rate of displacement lower than that in step (d).

12. The method defined in claim 1, further comprising the step of (g), outside of said at least one recess, displacing said electrode assembly relative to said substrate to sweep said forward end face portion of the anode in a scanning manner over the remaining surface areas of said substrate while continuing supply of said solution onto said areas and passage of said electric current between said anode and said substrate.

13. The method defined in claim 12, further comprising the step of controlling the rate of displacement in step (g) in accordance with the respective shape characteristics of said areas.

14. The method defined in claim 12 or claim 13, further comprising the step of controlling the magnitude of said electric current in step (g) in accordance with the respective shape characteristics of said areas.

15. The method defined in claim 12 or claim 13, wherein said elongate anode is tubular and formed with an inner passage open in said forward end face portion and wherein said solution is delivered onto said areas through said passage, further comprising the step of controlling delivery of said solution onto said areas in accordance with the respective shape characteristics of said areas.

16. An apparatus for carrying out the method of claim 1, comprising:

an electrode assembly comprising an elongate anode and a tubular insulator adapted to be passed by said elongate anode so as to partially cover the lateral surface thereof and movable in its longitudinal direction, first drive means for relatively displacing said elongate anode and said substrate;

second drive means independent of said first drive means for displacing said tubular insulator relative to said elongate anode;

fluid supply means for supply an electrodepositing solution onto said substrate;

power supply means for passing an electric current between said anode and said substrate; and control means adapted to be furnished with preprogrammed instructions to act on said first and second drive means for movement of said electrode assembly, said anode and said insulation in steps (b), (c) and (d).

17. The apparatus defined in claim 16 wherein said elongate anode is tubular and formed with an inner passage open in a forward end face portion of the anode, whereby said solution may be supplied into said recess through said inner passage.

18. The apparatus defined in claim 16 or 4, further including means for supplying said electrodepositing solution in steps (c), (d) and (f) at varying flow rates, and means for maximizing said rate of flow of said solution into said recess in step (f).

19. The apparatus defined in claim 16, further including means for maximizing said electric current magnitude in step (f).

20. The apparatus defined in claim 17, further including means for displacing said electrode assembly, outside of at least one recess, relative to said substrate to sweep said forward end face portion of the anode in a scanning manner over the remaining surface areas of said substrate while continuing supply of said solution onto said areas and passage of said electric current between said anode and said substrate, and means for controlling the rate of said displacement of said electrode assembly in accordance with the respective shape characteristics of said areas.

21. The apparatus defined in claim 18, further including means for controlling the magnitude of said electric current during said displacement of said electrode assembly in accordance with the respective shape characteristics of said areas.

22. The apparatus defined in claim 20 or claim 19, further including means for controlling delivery of said solution onto said areas in accordance with the respective shape characteristics of said areas.

* * * * *